US010208496B2

(12) United States Patent
Sanchez

(10) Patent No.: US 10,208,496 B2
(45) Date of Patent: Feb. 19, 2019

(54) COMBINING MULTIPLE POOL COMPONENTS

(71) Applicant: May Manufacturing, LLC, Las Vegas, NV (US)

(72) Inventor: Manuel Sanchez, Las Vegas, NV (US)

(73) Assignee: May Manufacturing, LLC, Las Vegas, NV (US)

( * ) Notice: Subject to any disclaimer, the term of this patent is extended or adjusted under 35 U.S.C. 154(b) by 0 days.

(21) Appl. No.: 15/783,856

(22) Filed: Oct. 13, 2017

(65) Prior Publication Data

US 2018/0119440 A1 May 3, 2018

Related U.S. Application Data

(60) Provisional application No. 62/415,622, filed on Nov. 5, 2016.

(51) Int. Cl.
*E04H 4/00* (2006.01)

(52) U.S. Cl.
CPC ... *E04H 4/0031* (2013.01); *E04H 2004/0068* (2013.01)

(58) Field of Classification Search
CPC ..... E04H 4/0031; E04H 2004/0068
USPC ..... 4/506, 584, 592–595
See application file for complete search history.

(56) References Cited

U.S. PATENT DOCUMENTS 6,507,959 B1 * 1/2003 Sundberg ..... A47K 3/024 4/584
7,086,994 B2 8/2006 Turak et al.
7,845,653 B2 * 12/2010 Katz ..... B25H 3/023 206/507
8,607,372 B2 12/2013 Hall

* cited by examiner

*Primary Examiner* — Tuan N Nguyen
(74) *Attorney, Agent, or Firm* — Chambliss, Bahner & Stopehl, P.C.

(57) ABSTRACT

A combination of a first separate and independent pool component and a second separate and independent pool component includes a first frame portion having a frame support component for the first pool component, and a second frame portion having a frame support component for the second pool component. The second frame portion is complementary with the first frame portion. A latch assembly has a first latch component and a second latch component. The first latch component is adapted to be removably coupled to the second latch component. The first latch component of the latch assembly is attached to the frame support component of the first frame portion of the first pool component, and the second latch component of the latch assembly is attached to the frame support component of the second frame portion of the second pool component. The first pool component and the second pool component are placed so that their complementary frame portions and the cooperating first and second latch components are aligned, and the first latch component of the latch assembly is operatively attached to the second latch component with which it is aligned.

13 Claims, 12 Drawing Sheets

COMBINING MULTIPLE POOL COMPONENTS

CROSS-REFERENCE TO RELATED APPLICATION

This application claims the benefit of U.S. Provisional Patent Application No. 62/415,622 which was filed on Nov. 1, 2016.

FIELD OF THE INVENTION

The present invention relates generally to pool components such as, but not limited to, exercise swim pools and spas. More particularly, the invention relates to a method for joining together two or more separate and independent pool components and to a combination of such pool components.

BACKGROUND OF THE INVENTION

An exercise swim pool, sometimes called an endless pool, is a known type of pool component. Generally, an exercise swim pool comprises a relatively compact device that permits a swimmer to exercise by swimming against a current generated by the device. An exercise swim pool typically includes a molded shell that is supported by a frame and forms a rectangular water containment or enclosure having a floor and an upstanding sidewall. The shells of some exercise swim pools have molded steps to allow access into the pool. The shell is typically constructed of fiberglass, plastic or a similar material, or a composite of such materials, and the frame is usually made of wood, aluminum or steel. An exercise swim pool is typically six or eight feet wide and twelve to twenty feet long. It includes a water distribution system comprising a propulsion pump that generates a flow of water from one end of the pool component to the other in order to provide sufficient resistance that a swimmer can remain stationary while swimming against the current generated. The water is circulated through return channels back to the propulsion pump so that the current flow against the swimmer may be maintained.

A spa, also called a hot tub, is another well-known pool component. A spa typically comprises a molded shell which forms a water containment or fluid enclosure having a floor and an upstanding sidewall. Molded within the enclosure are a plurality of therapy stations which may include seats or platforms for reclining. The spa shell, like that of an exercise swim pool, is typically constructed of fiberglass, plastic or a similar material, or a composite of such materials, and is supported by a wooden, aluminum or steel frame. A spa includes a water distribution system comprising one or more pumps that are usually placed under the shell to draw water from the enclosure and discharge it, usually with air, into the enclosure through a plurality of nozzles or jets of various types. The jets are usually mounted through the shell in either or both of the floor and sidewall. Typically, jets mounted through the sidewall are located below the water line of the spa, and in any event, the jets are designed to provide a comforting or therapeutic effect to a person occupying a therapy station. Water lines are provided between the various jets, pumps and water inlet ports, and are usually comprised of PVC piping and flexible tubing. Various filters, heaters, cleaning units and diverter valves may also be provided in the typical spa.

It is known to provide a combination exercise swim pool and spa as an integral unit. However, these combination pool/spas are generally quite large and difficult and expensive to ship because the pool components cannot be disengaged from each other. In addition, these known combination units are restricted to a limited number of sizes and configurations, even though exercise swim pools and spas are provided individually in many different sizes and configurations.

It would be desirable if a method could be provided for joining together two or more exercise swim pools, spas or other pool components. This would allow custom combinations to be constructed of variously sized exercise swim pools and variously sized spas. It would also allow the combination of two or more spas, or two or more exercise swim pools. It would also be desirable if such a method could be provided that would allow for the simple assembly of the combination by a dealer or salesman. Such a method would allow a dealer to stock variously sized pool components such as exercise swim pools and spas so that it could readily create a custom combination for any customer. Such a method would also permit a manufacturer to ship separate pool components such as exercise swim pools and spas that have been manufactured so as to be readily joined together according to the invention, rather than combination units, to its dealers and customers who want combination units.

Advantages of the Invention

Among the advantages of the invention is that it provides a method for combining two or more exercise swim pools, spas or other pool components. The invention thus allows combinations to be constructed of variously sized pool components such as exercise swim pools and spas, and it allows for the simple assembly of the combination by a dealer or salesman. Another advantage of the invention is that it allows a dealer to stock variously sized pool components such as exercise swim pools and spas that are configured so as to be readily joined together according to the invention. This allows a dealer to readily create a custom combination for any customer.

Another advantage of the invention is that it permits a manufacturer to ship separate pool components that have been manufactured so as to be readily joined together according to the invention, rather than combination units, to its dealers and customers who want combination units. Other advantages and features of this invention will become apparent from an examination of the drawings and the ensuing description.

NOTES ON CONSTRUCTION

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

Terms concerning attachments, such as "coupled", "connected" and "interconnected", refer to a relationship wherein structures are secured or attached to one another either directly or indirectly through intervening structures, as well as both moveable and rigid attachments or relationships, unless specified herein or clearly indicated by context. The terms "operatively attached", "operatively connected" and similar terms describe such an attachment, coupling or connection that allows the pertinent structures to operate as intended by virtue of that relationship.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity. The following terms are specifically defined, and are to be given their broadest reasonable construction consistent with such definitions, as follows:

The term "pool component" refers to a device comprising a shell that is supported by a frame and forms a water containment or enclosure having a floor and an upstanding sidewall, and includes a water distribution system including at least one pump. Pool components include devices sold as exercise swim pools, endless pools, spas and hot tubs.

The term "separate and independent", as used herein to refer to pool components that may be joined together according to the invention, means that each of the pool components is capable of independent stand-alone operation according to its intended purpose, without being coupled to another pool component according to the invention.

The term "complementary", as used herein to refer to the attachment of frame portions of pool components to each other according to the invention, means that the frame portions of the pool components are configured so that they may be placed adjacent to each other and aligned so that the frame portions of the pool components may be joined together according to the invention.

The complementary frame portions do not need to be the same size, although such a configuration is preferred.

SUMMARY OF THE INVENTION

The invention comprises a method for combining two or more separate and independent pool components that have complementary frame portions, and a combination of separate and independent pool components. The invention includes a latch assembly that has a first latch component and a second latch component. The first latch component of the latch assembly can be removably coupled to the second latch component. The first latch component of the latch assembly is attached to a frame portion of a first pool component and the second latch component is attached to a complementary frame portion of a second pool component. The pool components are placed so that their complementary frame portions and the cooperating first and second latch components are aligned, and the first latch component of the latch assembly is coupled to the second latch component with which it is aligned. In a preferred embodiment of the invention, a plurality of latch assemblies are employed to join together separate and independent pool components. In an especially preferred embodiment of the invention, the latch assemblies each comprise latch action toggle clamp assemblies.

In order to facilitate an understanding of the invention, the preferred embodiments of the invention, as well as the best mode known by the inventor for carrying out the invention, are illustrated in the drawings, and a detailed description thereof follows. It is not intended, however, that the invention be limited to the particular embodiments described or to use in connection with the specific apparatus illustrated herein. Therefore, the scope of the invention contemplated by the inventor includes all equivalents of the subject matter described herein, as well as various modifications and alternative embodiments such as would ordinarily occur to one skilled in the art to which the invention relates. The inventor expects skilled artisans to employ such variations as seem to them appropriate, including the practice of the invention otherwise than as specifically described herein. In addition, any combination of the elements and components of the invention described herein in any possible variation is encompassed by the invention, unless otherwise indicated herein or clearly excluded by context.

BRIEF DESCRIPTION OF THE DRAWINGS

The presently preferred embodiments of the invention are illustrated in the accompanying drawings, in which like reference numerals represent like parts throughout, and wherein.

DESCRIPTION OF THE PREFERRED EMBODIMENTS OF THE INVENTION

Figure 1:
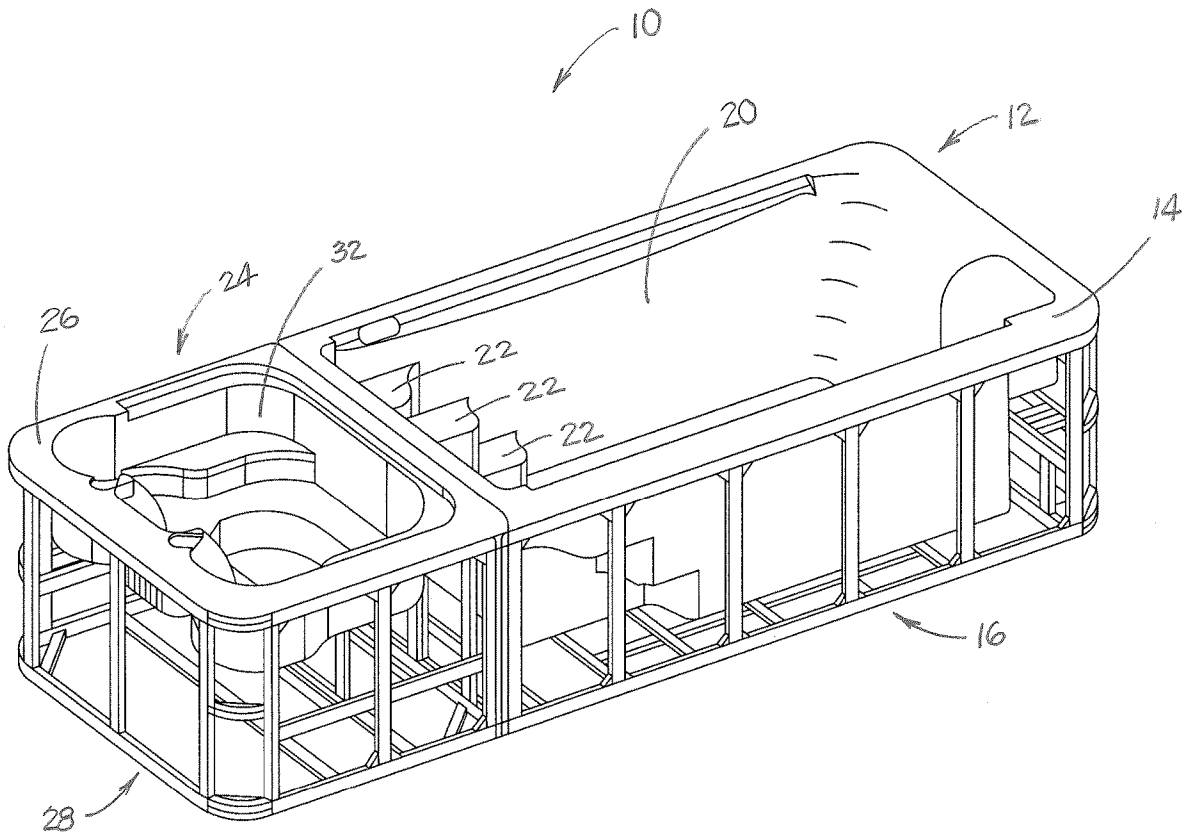
FIG. 1 is a side perspective view of a pair of pool components, namely an exercise swim pool and a spa, which components have been joined together in a combination having a first configuration according to the invention.

This description of preferred embodiments of the invention is intended to be read in connection with the accompanying drawings, which are to be considered part of the entire written description of this invention. The drawing figures are not necessarily to scale, and certain features of the invention may be shown exaggerated in scale or in somewhat schematic form in the interest of clarity and conciseness.

FIGS. 1-5 illustrate combination 10 of pool components in a first configuration according to the invention. Combination 10 includes a first pool component in the form of exercise swim pool 12, which comprises molded swim pool shell 14 that is supported by frame 16. Exercise swim pool 12 comprises a rectangular water containment or enclosure having floor 18 and upstanding sidewall 20. Shell 14 includes a plurality of molded steps 22 to allow access into the pool component. Exercise swim pool 12 includes a conventional water distribution system (not shown) comprising a propulsion pump that generates a flow of water from one end of the pool component to the other in order to provide sufficient resistance that a swimmer can remain stationary while swimming against the current generated. The water is circulated through return channels back to the propulsion pump so that the current flow against the swimmer may be maintained.

Combination 10 also includes a second pool component in the form of spa 24, which comprises molded spa shell 26 that is supported by frame 28. Spa 24 comprises a water containment or fluid enclosure having floor 30 and upstanding sidewall 32. Molded within the enclosure are a plurality of therapy stations which may include seats or platforms for reclining. Spa 24 includes a conventional water distribution system (not shown) comprising one or more pumps that are usually placed under the shell to draw water from the enclosure and discharge it, usually with air, into the enclosure through a plurality of nozzles or jets of various types. Spa 24 may also be provided with various conventional filters, heaters, cleaning units and diverter valves as are known to those having ordinary skill in the art to which the invention relates.

Exercise swim pool 12 and spa 24 are capable of independent stand-alone operation according to their intended purposes, without being coupled together according to the invention. Nevertheless, the invention comprises a method for joining these separate and independent pool components, and a combination of such pool components as coupled according to the invention.

Figure 2:
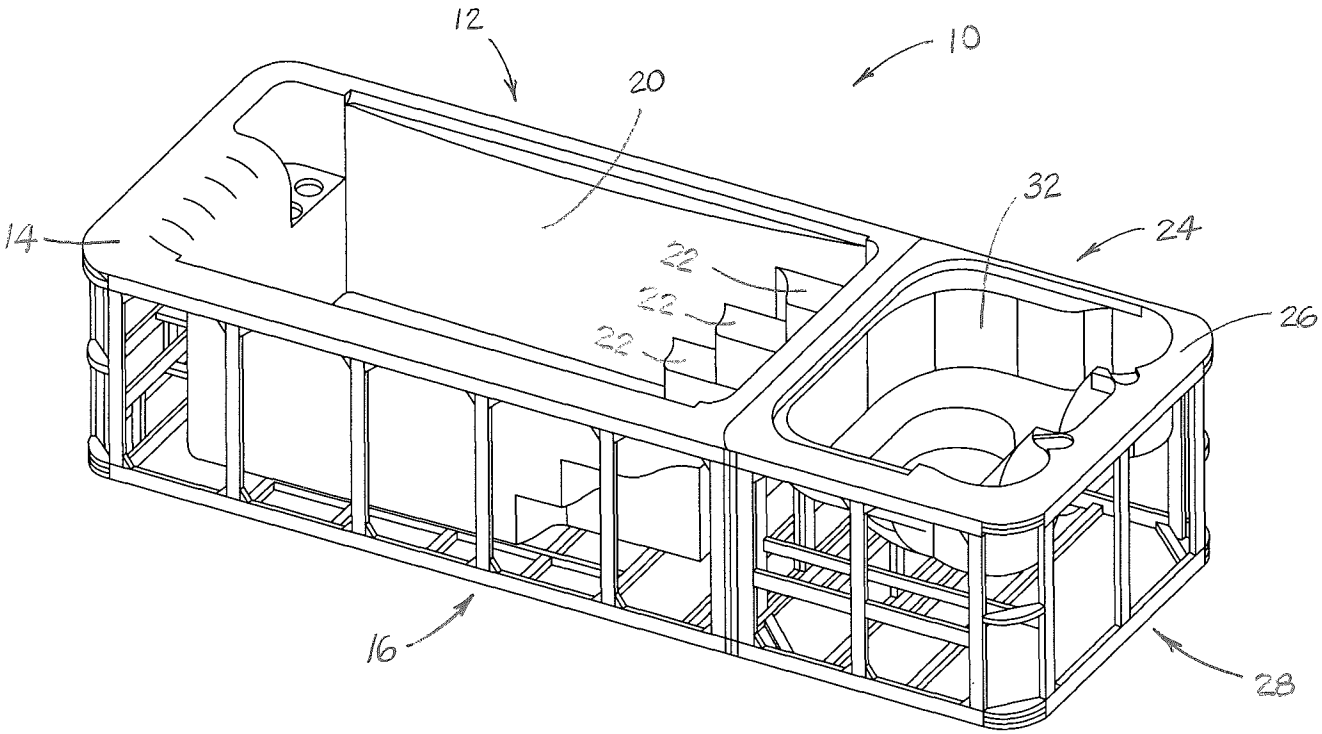
FIG. 2 is a side perspective view of the combination of pool components shown in FIG. 1, taken from the opposite side from the view shown in FIG. 1.
Figure 3:
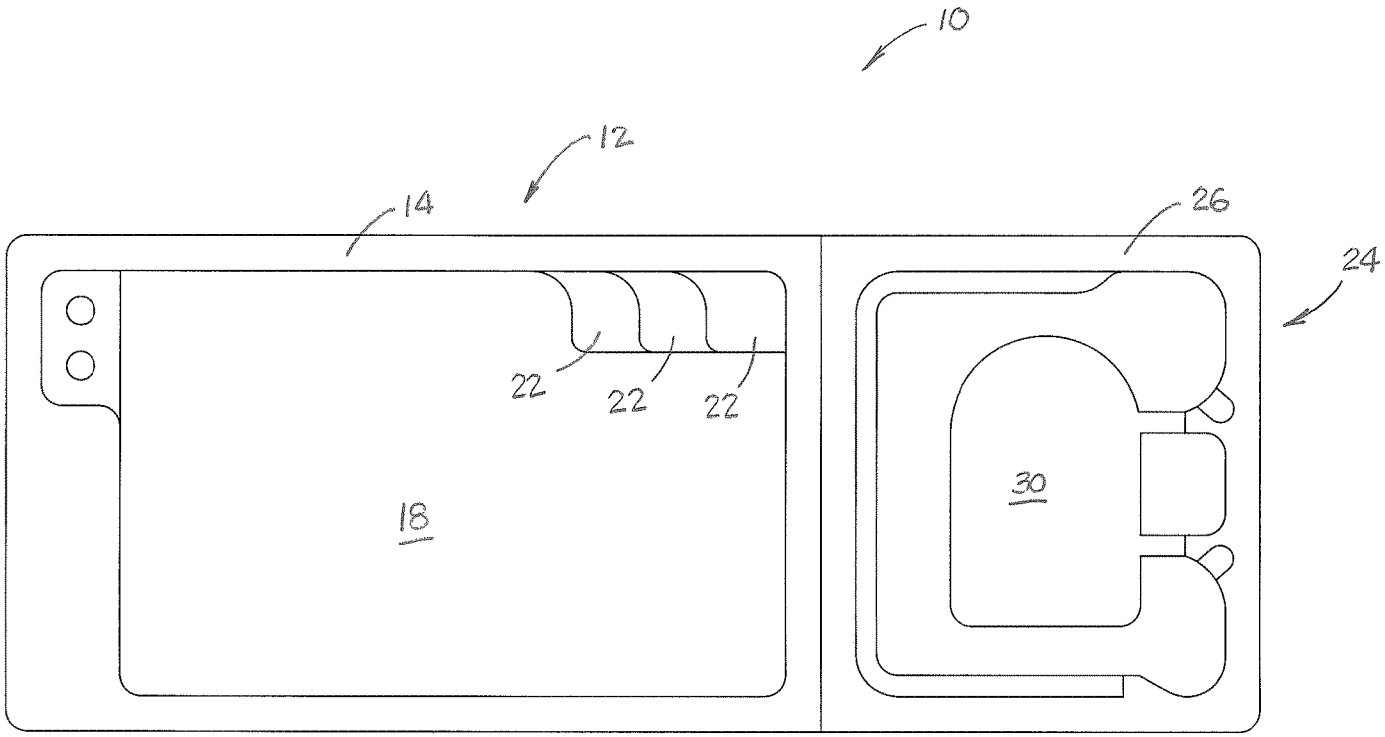
FIG. 3 is a top view of the combination of pool components shown in FIG. 2.
Figure 4:
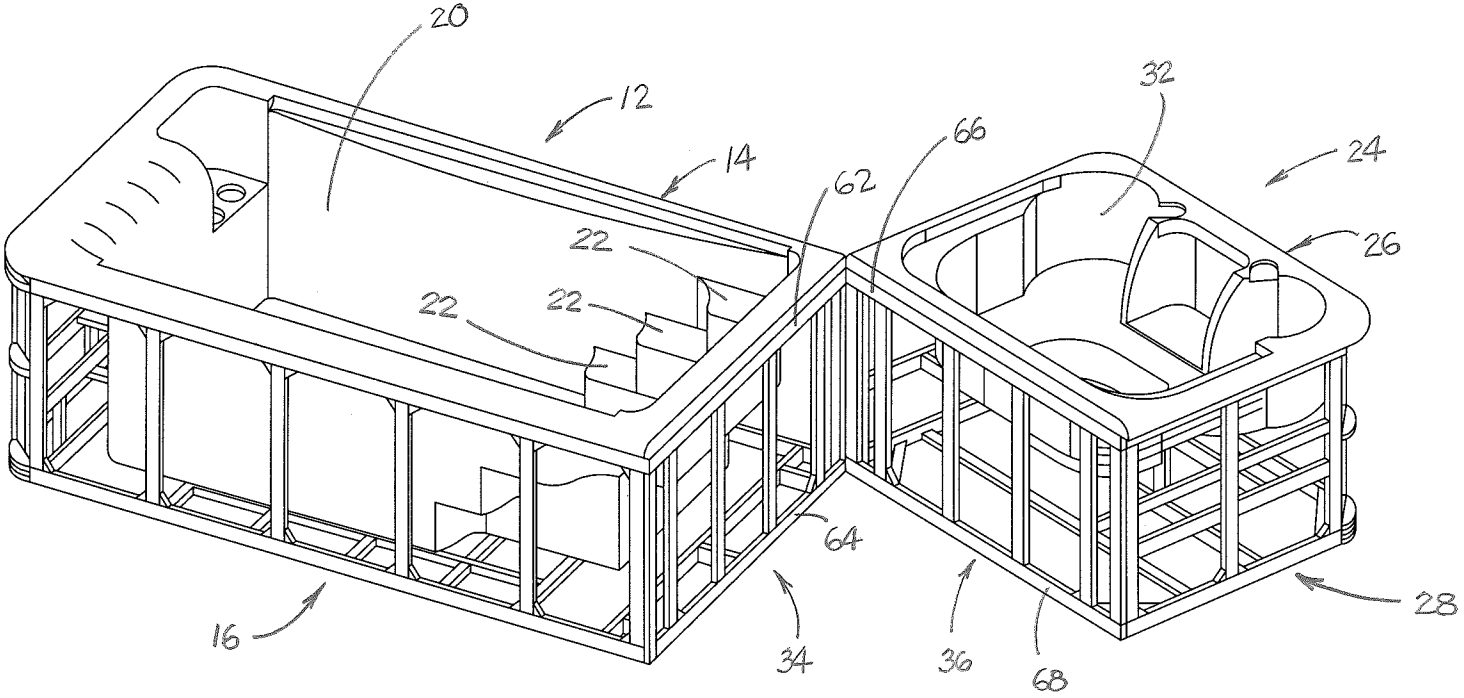
FIG. 4 is a side perspective view of the pool components of the combination shown in FIGS. 1-3, with the pool components having been separated.
Figure 5:
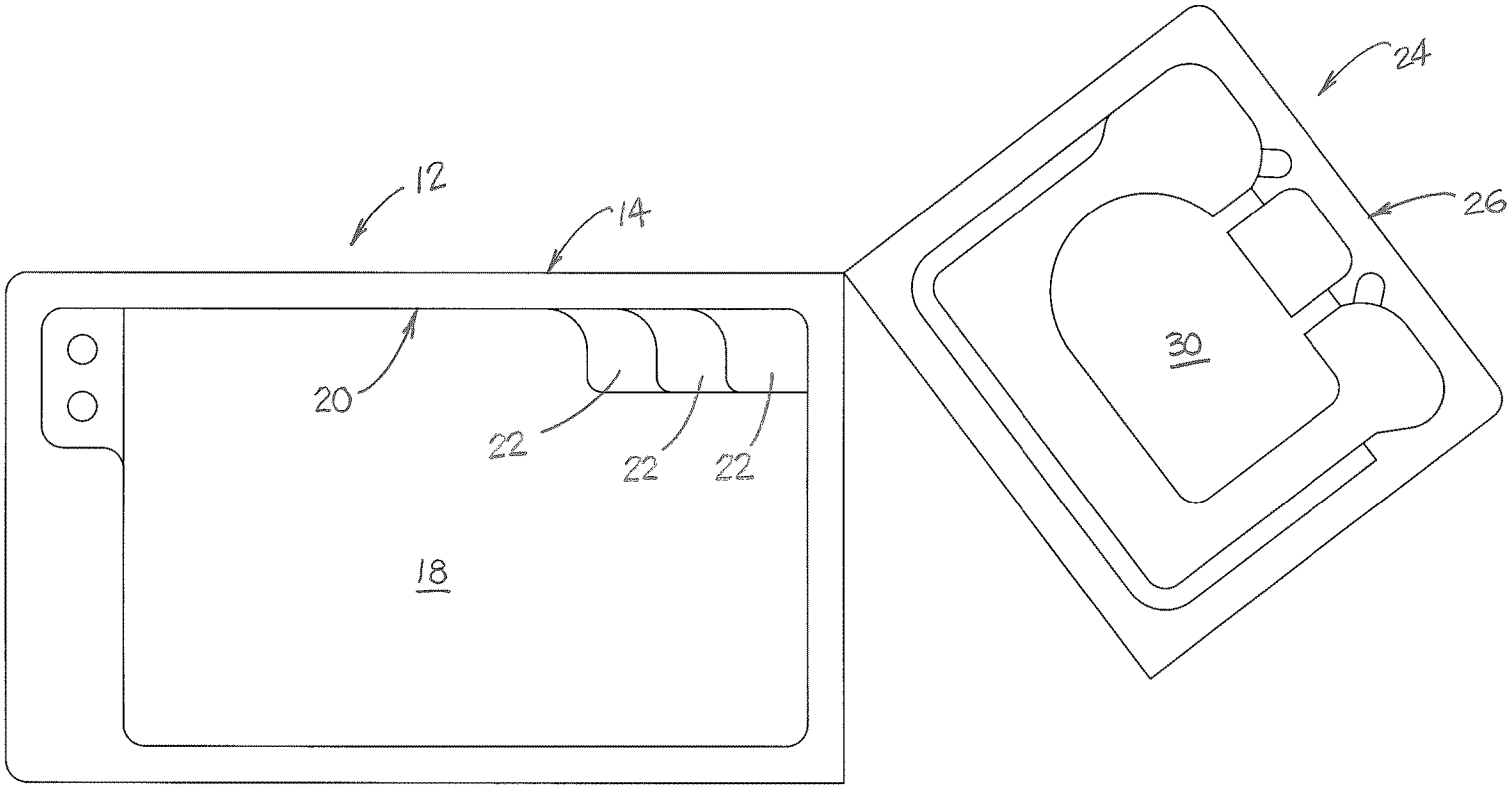
FIG. 5 is a top view of the separated pool components shown in FIG. 4.

Frame 16 of exercise swim pool 12 has a frame portion 34 (shown in FIGS. 4 and 10) that is complementary with frame portion 36 of frame 28 of spa 24. Thus, frame portion 34 includes vertical support components 38, 40, 42, 44, 46 and 48 that are adapted to align with vertical support components 50, 52, 54, 56, 58 and 60, respectively, of complementary frame portion 36, and frame portion 34 includes top horizontal support component 62 and bottom horizontal support component 64 that are adapted to align with top horizontal support component 66 and bottom horizontal support component 68, respectively, of complementary frame portion 36. Furthermore, frame portion 34 and shell 14 of exercise swim pool 12 are configured and arranged so as to align with and abut against frame portion 36 and shell 26 of spa 24 as shown in FIGS. 1-3.

Figure 6:
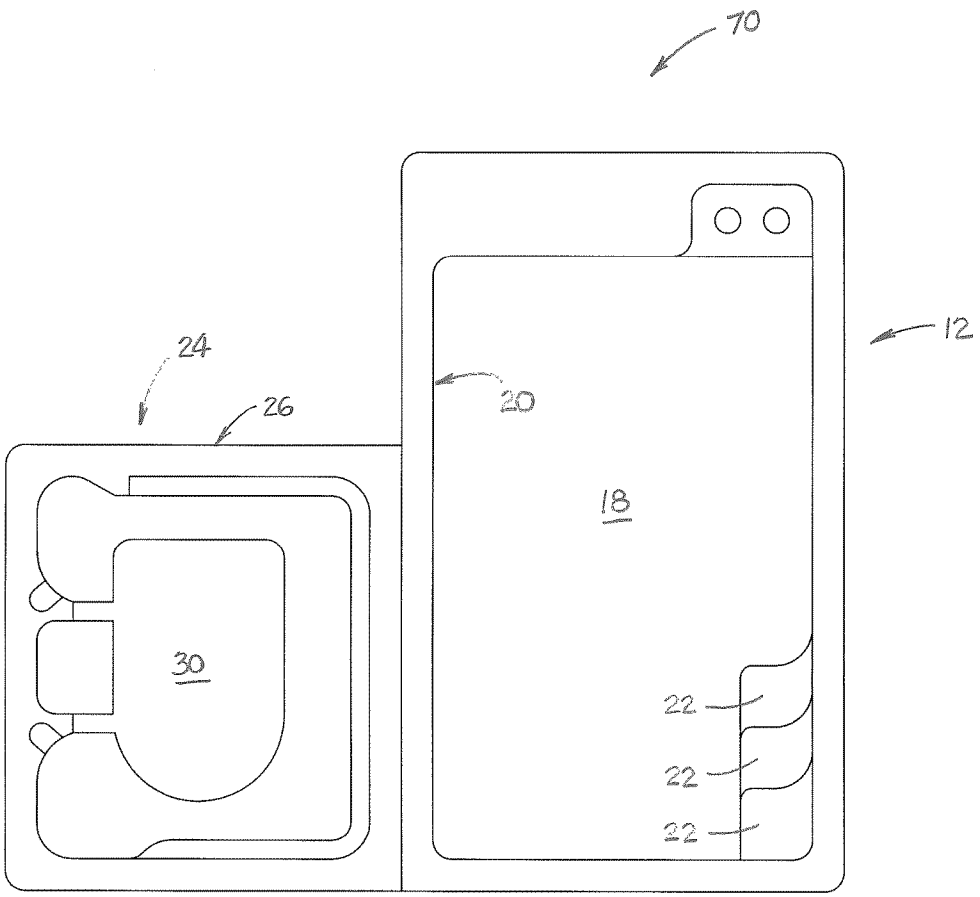
FIG. 6 is a top view of a pair of pool components, namely an exercise swim pool and a spa, which components have been joined together in a combination having a second configuration according to the invention.
Figure 7:
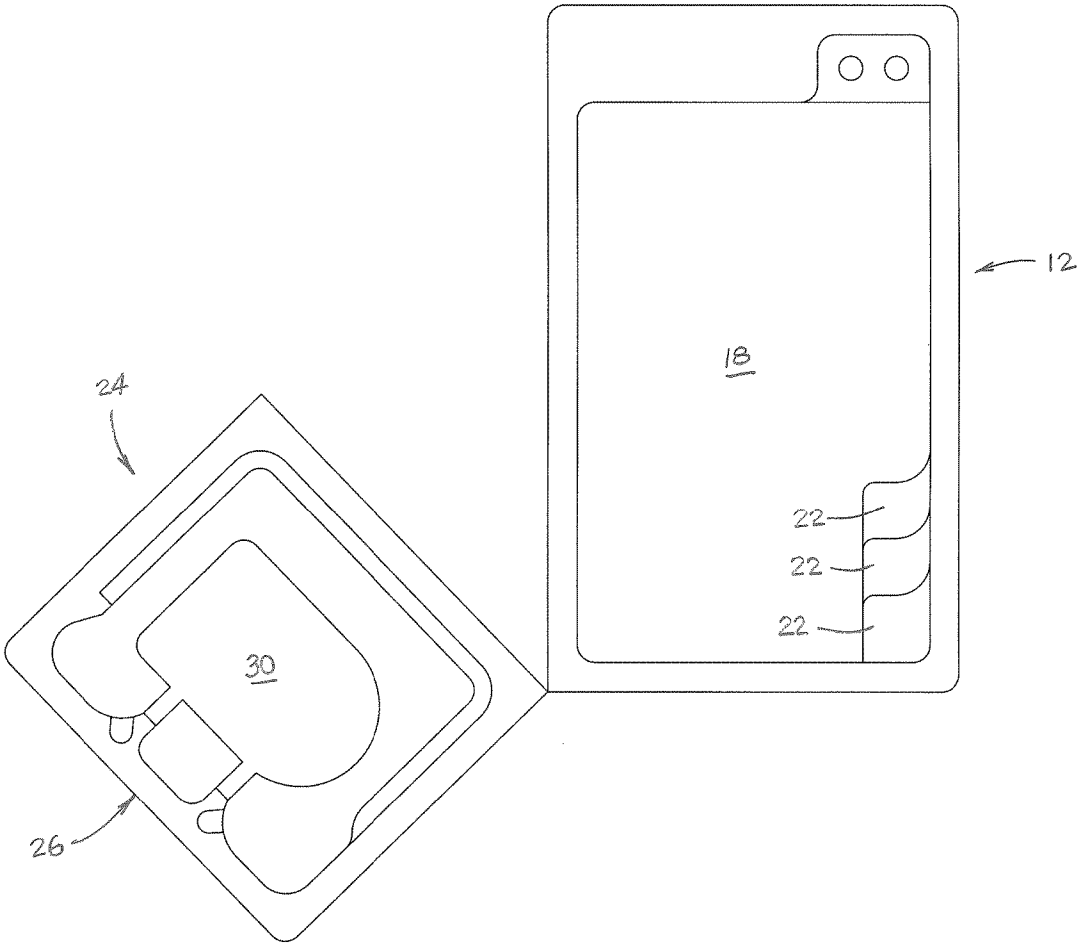
FIG. 7 is a top view of the pool components of the combination shown in FIG. 6, with the pool components having been separated.

FIGS. 6 and 7 illustrate combination 70 of pool components 12 and 24 in a second configuration according to the invention. As shown therein, combination 70 includes a first pool component in the form of exercise swim pool 12 and a second pool component in the form of spa 24. These pool components include complementary frame portions that may be aligned in order to join the pool components together according to the invention, in essentially the same way that the frame portions of the pool components are joined together to form combination 10.

Figure 8:
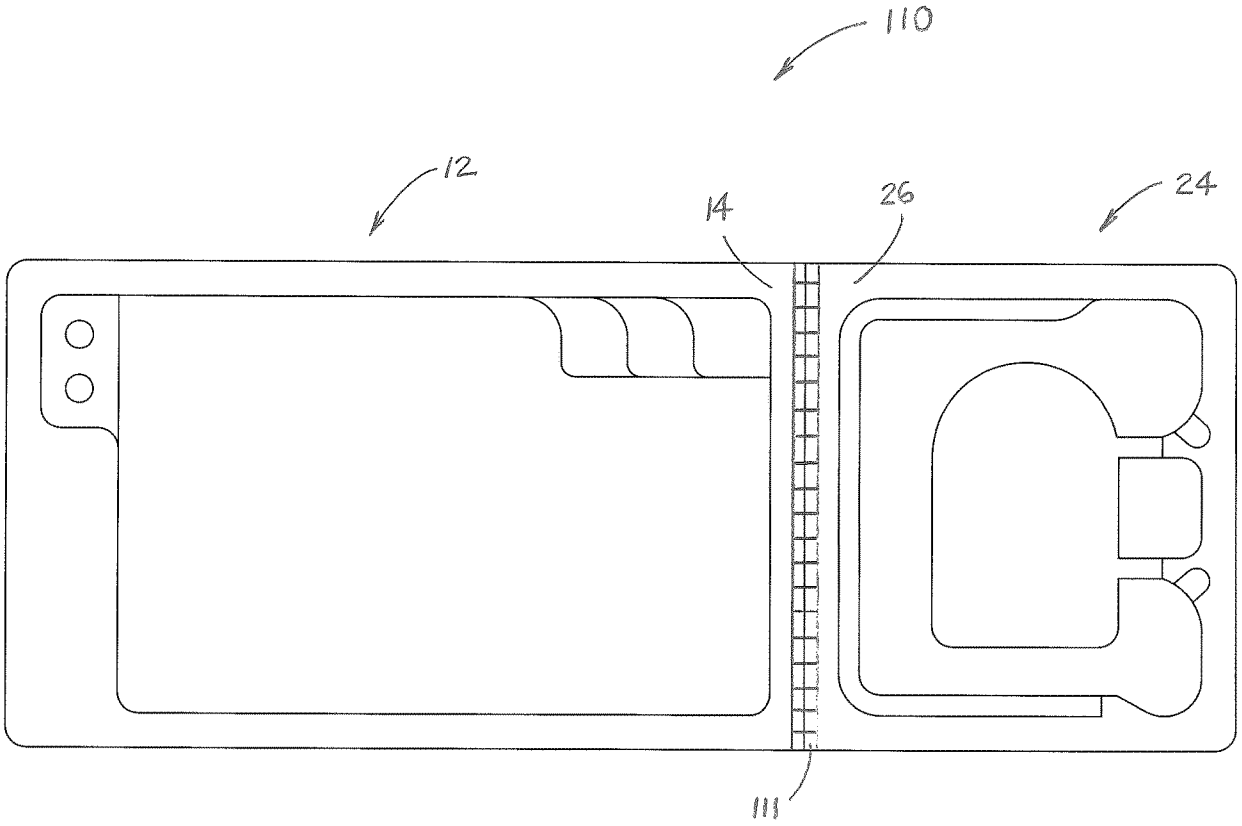
FIG. 8 is a top view of a pair of pool components, namely an exercise swim pool and a spa, which components have been joined together in a combination having a the same configuration as that shown in FIGS. 1-5, but illustrating an additional feature of a preferred embodiment of the invention.
Figure 9:
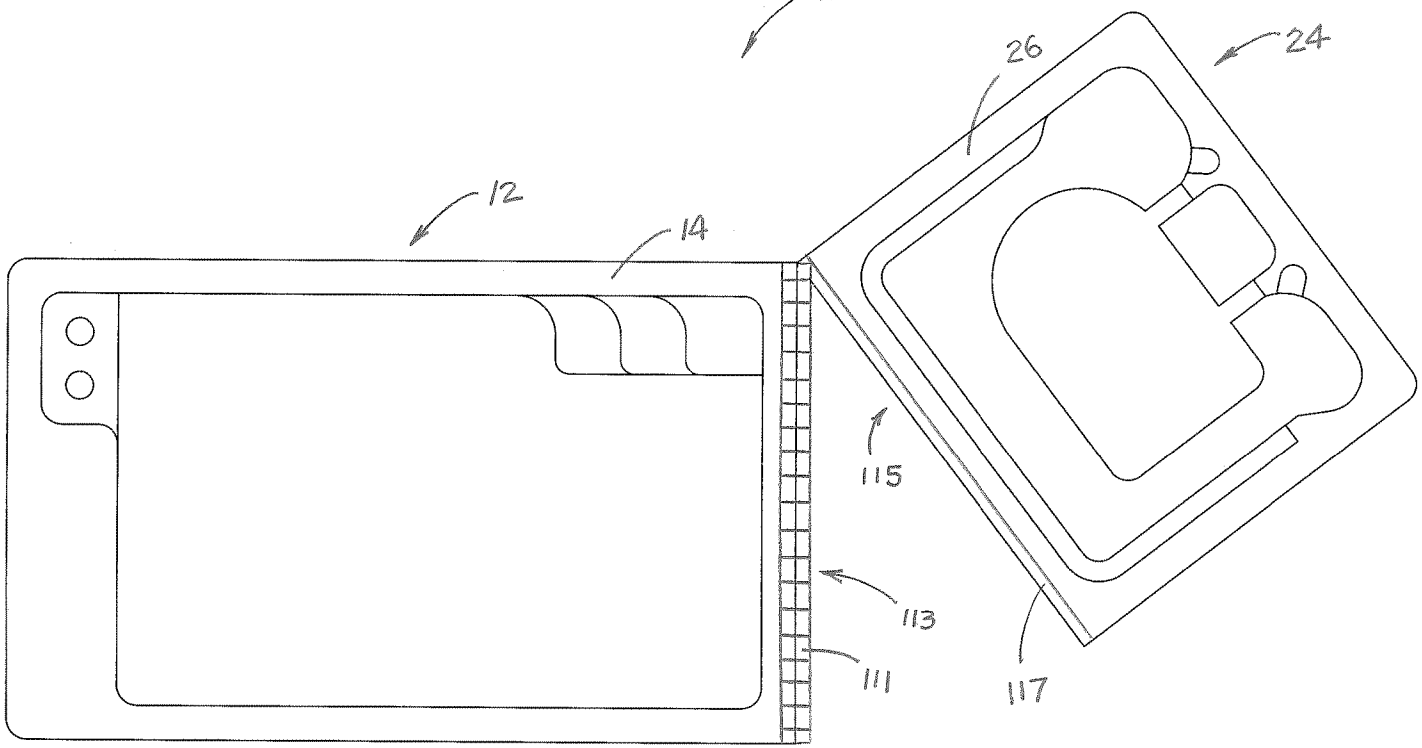
FIG. 9 is a top view of the pool components of the combination shown in FIG. 8, with the pool components having been separated.

FIGS. 8 and 9 illustrate combination 110 of pool components 12 and 24 in a configuration that is essentially identical to that of combination 10, except that it includes an overlapping tile edge 111 that appears to provide a seamless joint between a first pool component comprising exercise swim pool 12 and a second pool component comprising spa 24. In this configuration of the invention, a tile edge is provided to cover any gap between the first pool component and the second pool component when the pool components are combined according to the invention. Thus, as shown in FIGS. 8 and 9, tile edge 111 is attached to first side 113 of exercise swim pool 12 that abuts second side 115 of spa 24. In one embodiment, the tile edge is mounted in a recess (not shown) in the upper surface of shell 14 of exercise swim pool 12 and extends outwardly of side 113 by an amount equal to the width of a corresponding recess 117 in shell 26 on side 115 of spa 24 so that tile edge 111 will lie flush with the upper surface of shell 14 of exercise swim pool 12 and the upper surface of shell 26 of spa 24 when the two pool components are joined together according to the invention. A bead of caulk may be placed alongside the side of tile edge 111 that abuts shell 26 of spa 24 so as to create a seamless appearance. Of course, the tile edge may alternatively be mounted in recess 117 in the upper surface of shell 26 of spa 24 so as to extend outwardly of side 115 by an amount equal to the width of a corresponding recess in shell 14 on side 113 of exercise swim pool 12. In another embodiment of the invention, shell 14 on side 113 of exercise swim pool 12 may have a generally flat upper surface that abuts a corresponding flat upper surface of shell 26 on side 115 of spa 24. In this embodiment, neither shell 14 nor shell 26 has a recess, and tile edge 111 is attached to the flat upper surfaces of the abutting shells in such a manner as to overlap the abutment between first side 113 of exercise swim pool 12 and second side 115 of spa 24 so as to cover any gap between the two pool components. A bead of caulk may be placed on both sides of tile edge 111 to finish the joint between the two pool components. In yet another embodiment of the invention, neither shell 14 nor shell 26 has a recess, and tile edge 111 is attached to the flat upper surface of one of the abutting shells so as to be flush with the edge of the shell on the side to be joined with the other pool component according to the invention. In this embodiment, a bead of caulk is applied on the side of tile edge 111 adjacent to the abutting shell to overlap the abutment between first side 113 of exercise swim pool 12 and second side 115 of spa 24 and to cover any gap between the two pool components.

Figure 10:
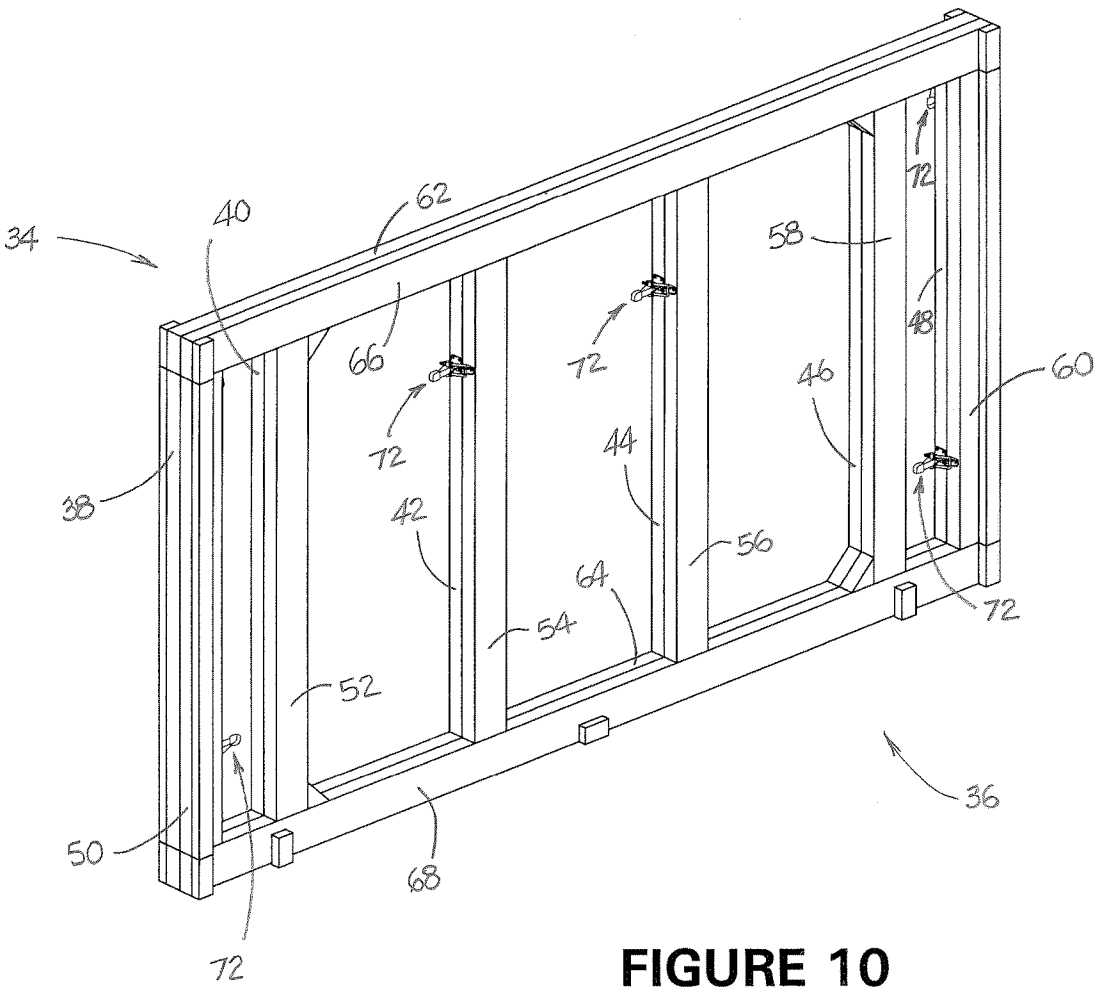
FIG. 10 is a perspective view of complementary frame portions of a pair of pool components such as the pool components shown in FIGS. 1-9, illustrating how the frame portions of two pool components are joined together according to the invention.
Figure 12:
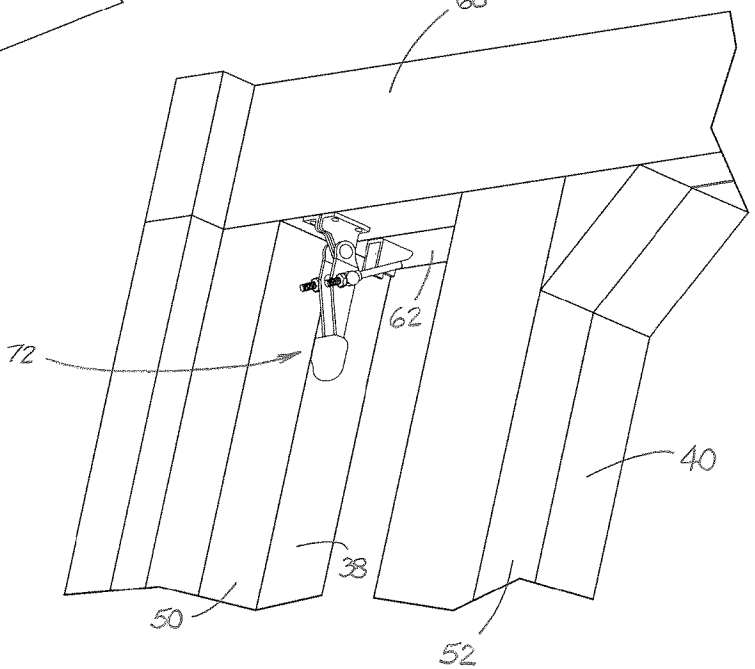
FIG. 12 is a perspective view of portions of two complementary frame portions, illustrating the operation of a preferred latch assembly that is mounted on horizontally oriented support components of the complementary frame portions of two pool components according to the invention.
Figure 11:
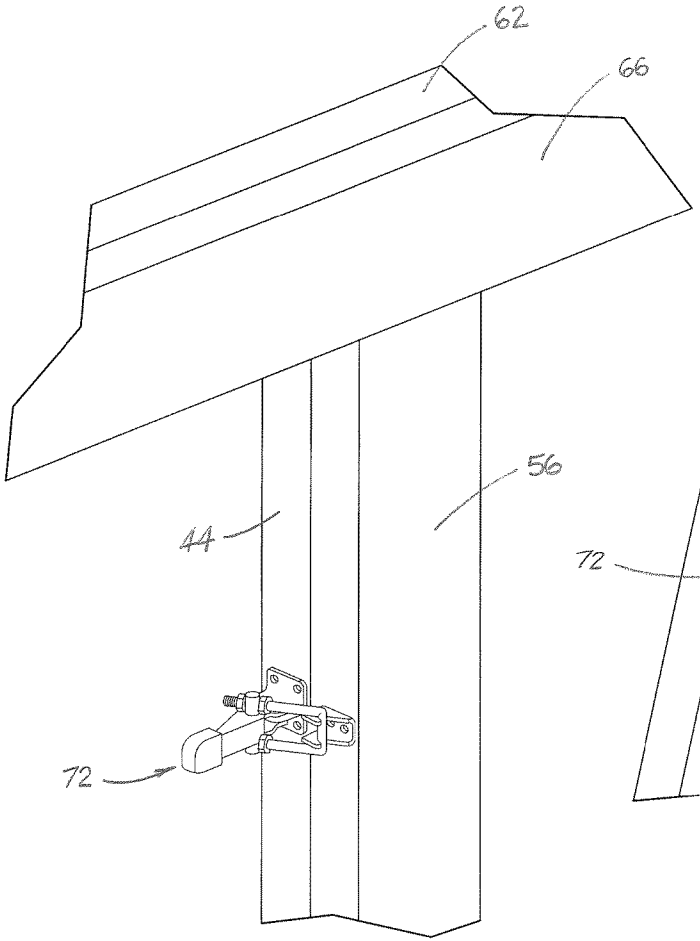
FIG. 11 is a perspective view of support components of two complementary frame portions, illustrating the operation of a preferred latch assembly that is mounted on vertically oriented support components of the complementary frame portions of two pool components according to the invention.
Figure 13:
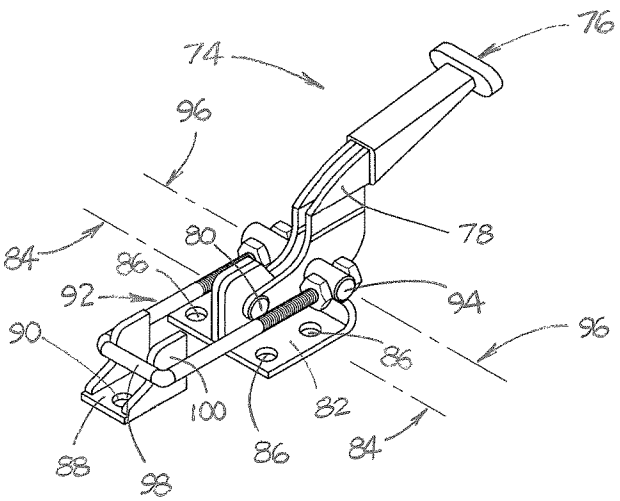
FIG. 13 is a perspective view of a preferred latch action toggle clamp assembly that is employed in a preferred embodiment of the invention.
Figure 16:
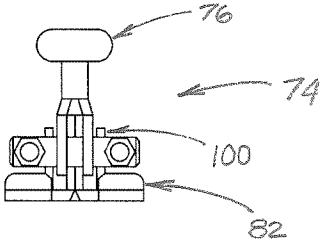
FIG. 16 is an end view of the latch action toggle clamp assembly shown in FIGS. 13-15, illustrating an end view of the locked configuration of the latch action toggle clamp assembly.
Figure 14:
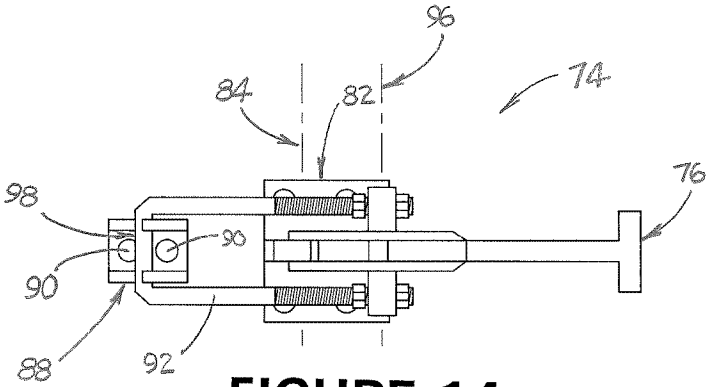
FIG. 14 is a top view of the latch action toggle clamp assembly shown in FIG. 13.
Figure 15:
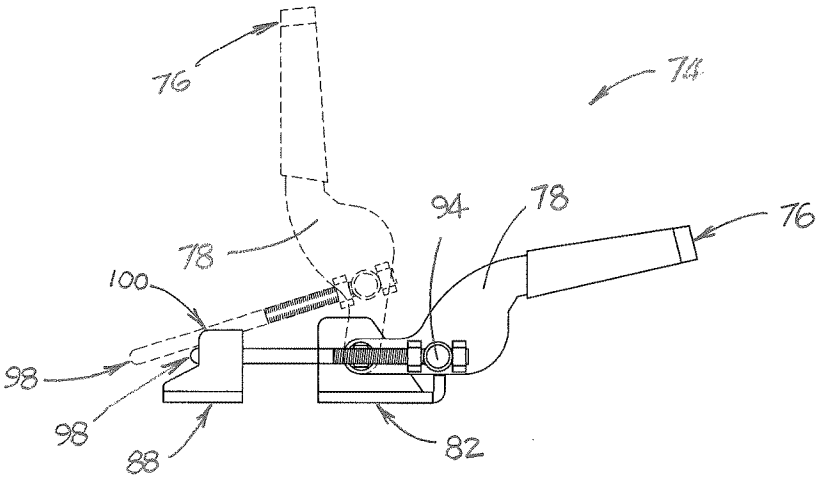
FIG. 15 is a side view of the latch action toggle clamp assembly shown in FIGS. 13 and 14, illustrating both the locking and the unlocking configuration of the latch action toggle clamp assembly.

As shown in FIG. 10, a plurality of latch assemblies 72 are attached to the complementary frame portions 34 and 36. Preferably, six such latch assemblies are employed, in the embodiments and configurations of the invention shown in the drawings. It is also preferred that these latch assemblies are mounted at different locations between frame portion 24 of frame 16 of exercise swim pool 12 and complementary frame portion 36 of frame 28 of spa 24. Thus, as shown in FIGS. 10-12, latch assemblies 72 are attached between vertical support component 38 of frame portion 34 and vertical support component 50 of frame portion 36, between vertical support component 42 of frame portion 34 and vertical support component 54 of frame portion 36, between vertical support component 44 of frame portion 34 and vertical support component 56 of frame portion 36, and between vertical support component 48 of frame portion 34 and vertical support component 60 of frame portion 36. Similarly, latch assemblies 72 are attached between top horizontal support component 62 of frame portion 36 and top horizontal support component 66 of frame portion 36 near vertical supports 48 and 60 (shown in FIG. 10) and between top horizontal support component 62 of frame portion 36 and top horizontal support component 66 of frame portion 36 near vertical supports 38 and 50 (shown in FIG. 12). Of course, more or less than six latch assemblies may be employed, and they may be placed at any of various convenient locations on and between complementary frame portions 34 and 36.

FIGS. 13-16 illustrate preferred latch action toggle clamp assembly 74 that may be employed in connection with the invention. Latch action toggle clamp assembly 74 is essentially identical to latch assemblies 72 except for the shape of handle portion 76. Latch action toggle clamp assembly 74 includes a first latch component (or "first latch means") and a second latch component (or "second latch means"). The first latch component of latch action toggle clamp assembly 74 comprises lever portion 78 to which handle portion 76 is attached, which lever portion is pivotally mounted, by means of pivot pin 80 on first bracket 82. Lever portion 78 of the first latch component is thus adapted to pivot with respect to first bracket 82 about pivot axis 84. First bracket 82 is provided with a plurality of screw holes 86 by which first bracket 82 may be attached to either frame portion 34 or frame portion 36. Latch action toggle clamp assembly 74 also includes a second latch component comprising second bracket 88, which is adapted to be attached to the frame portion adjacent to the one to which first bracket 82 is attached. Second bracket 88 is provided with screw holes 90 to facilitate its attachment to the frame portion opposite to the one to which first bracket 82 is attached. As shown in FIGS. 13-16, second bracket 88 is located on a frame portion so as to be in alignment with first bracket 82 on the other, complementary frame portion. The first latch component of latch action toggle clamp assembly 74 also includes U-shaped lock portion 92 that is pivotally mounted, by means of pivot pin 94 on lever portion 78 so as to pivot with respect to the lever portion about pivot axis 96. End 98 of U-shaped lock portion 92 is adapted to engage with upper portion 100 of second bracket 88 when the latch action toggle clamp assembly is in the operatively connected and locked position shown in FIGS. 13, 14 and 16. By manipulating handle portion 76 of latch action toggle clamp assembly 74 when the two complementary frame portions are properly aligned, lever portion 78 may be pivoted between the locked position shown in solid lines in FIG. 15 in which end 98 of U-shaped lock portion 92 engages and is coupled to the upper portion 100 of second bracket 88 and the unlocked position shown in dashed lines in which end 98 of U-shaped lock portion 92 is uncoupled from upper portion 100 of second bracket 88. Thus, latch action toggle clamp assembly 74 can removably lock the frames of first and second pool components together to create a combination of multiple pool components. If the complementary frame portions are sized and shaped identically, as shown in FIGS. 1, 2, 4 and 10, the combination 10 or the combination 70 can be configured to present a clean joint between the two separate pool components.

The preferred embodiment of the invention thus includes a plurality of latch assemblies, each of which includes a first latch component comprising first bracket 82 and a second latch component comprising second bracket 88 that can be removably coupled to the first latch component by means of U-shaped lock portion 92. The first latch component is attached to a frame portion of the first pool component and the second latch component is attached to a complementary frame portion of the second pool component. The pool components are placed so that their complementary frame portions and the cooperating first and second latch components are aligned, and the first latch component of each latch assembly is removably coupled to the second latch component with which it is aligned.

The invention thus provides a method and apparatus for combining two or more pool components, including but not limited to exercise swim pools and spas. These combinations can be constructed of variously sized pool components, and it allows for the simple assembly of the combination by a dealer or salesman using only a drill and a screwdriver. The invention thus allows a dealer to stock variously sized exercise swim pools and variously sized spas, for example, which pool components are provided with complementary frame portions that are configured so as to be readily joined together, thus providing the flexibility to allow a dealer to readily create a custom combination for any customer. The invention also permits a manufacturer to ship separate pool components such as exercise swim pools and spas that have been manufactured so as to be readily joined together, rather than combination units, to its dealers and customers who want combination units.

Although this description contains many specifics, these should not be construed as limiting the scope of the invention but as merely providing illustrations of the presently preferred embodiments thereof, as well as the best mode contemplated by the inventor of carrying out the invention. The invention, as described and claimed herein, is susceptible to various modifications and adaptations, as would be understood by those having ordinary skill in the art to which the invention relates.

What is claimed is:

1. A method comprising:

(a) providing a first pool component having a first frame for supporting the first pool component;

(b) providing a second pool component having a second frame for supporting the second pool component, wherein the second frame may be placed adjacent to and removably coupled with the first frame;

(c) providing a latch assembly for removably coupling the first frame together with the second frame, the latch assembly comprising:

a first latch means; and a second latch means configured to removably couple to the first latch means;

(d) attaching one of the first or second latch means of the latch assembly to the first frame of the first pool component;

(e) attaching the other of the first or second latch means of the latch assembly to the second frame of the second pool component;

(f) placing the first pool component and the second pool component so that the first and second frames and the first and second latch means are aligned;

(g) operatively attaching the first latch means of the latch assembly to the second latch means with which it is aligned.

2. The method of claim 1 which includes:

(a) providing the first pool component with a first frame further comprising a first vertical frame support and a second vertical frame support;

(b) providing the second pool component with a second frame further comprising a first vertical frame support that is adapted to be aligned with the first vertical support of the first frame, and a second vertical frame support that is adapted to be aligned with the second vertical support of the first frame;

(c) wherein the latch assembly provided in Step 1(c) comprises a first latch assembly and a second latch assembly, each latch assembly having a first latch means and a second latch means, wherein the first latch means is adapted to be removably coupled to the second latch means;

(d) attaching the first latch means of the first latch assembly to the first vertical frame support of the first frame of the first pool component;

(e) attaching the second latch means of the first latch assembly to the first vertical frame support of the second frame of the second pool component;

(f) attaching the first latch means of the second latch assembly to the second vertical frame support of the first frame of the first pool component;

(g) attaching the second latch means of the second latch assembly to the second vertical frame support of the second frame of the second pool component;

(h) placing the first pool component and the second pool component so that the first vertical frame support of the first frame is aligned with the first vertical support of the second frame, and the second vertical frame support of the first frame is aligned with the second vertical support of the second frame, and the first latch means of the first latch assembly is aligned with the second latch means of the first latch assembly, and the first latch means of the second latch assembly is aligned with the second latch means of the second latch assembly;

(i) operatively attaching the first latch means of the first latch assembly to the second latch means with which it is aligned;

(j) operatively attaching the first latch means of the second latch assembly to the second latch means with which it is aligned.

3. The method of claim 1 which includes:

(a) providing the first pool component with said first frame further comprising a top horizontal frame support;

(b) providing the second pool component with said second frame that is complementary with the first frame, said second frame further comprising a top horizontal frame support that is adapted to be aligned with the top horizontal frame support of the first frame;

(c) attaching the first latch means of the latch assembly to the top horizontal frame support of the first frame of the first pool component;

(d) attaching the second latch means of the latch assembly to the top horizontal frame support of the second frame of the second pool component;

(e) placing the first pool component and the second pool component so that the top horizontal frame support of the first frame is aligned with the top horizontal support of the second frame, and the first latch means of the latch assembly is aligned with the second latch means of the latch assembly;

(f) operatively attaching the first latch means of the latch assembly to the second latch means with which it is aligned.

4. The method of claim 1 wherein:

(a) the first latch means comprises:

(i) a first bracket;

(ii) a lever portion that is pivotally mounted to the first bracket;

(iii) a U-shaped lock portion that is pivotally mounted to the lever portion;

(b) the second latch means comprises a second bracket;

wherein the U-shaped lock portion of the first latch means is adapted to be removably coupled to the second bracket.

5. The method of claim 4 wherein the lever portion is adapted to be pivoted between a locked position in which the U-shaped lock portion is coupled to the second bracket and an unlocked position in which the U-shaped lock portion is uncoupled from the second bracket.

6. A combination of pool components comprising:

(a) a latch assembly comprising a first latch means and a second latch means, wherein the first latch means is adapted to be removably coupled to the second latch means;

(b) a first pool component comprising a first frame to which the first latch means is attached;

(c) a second pool component comprising a second frame to which the second latch means is attached, said second frame complementary with the first frame;

wherein:

(d) the first pool component and the second pool component are located so that the first frame is aligned with the second frame and the first latch means is aligned with the second latch means;

(e) the first latch means of the latch assembly is operatively attached to the second latch means.

7. The combination of claim 6 which includes:

(a) the first pool component further comprising:

(a) a first side;

(b) a first shell with an upper surface;

(b) the second pool component further comprising:

(a) a second side;

(b) a second shell with an upper surface;

(d) a tile edge that is attached to the upper surface of at least one of the first and second shells so as to provide an apparent seamless joint between the first pool component and the second pool component.

8. The combination of claim 6 which includes:

(a) said first pool component further comprising a first side;

(b) said second pool component further comprising a second side that abuts the first side of the first pool component;

(c) a tile edge that overlaps the abutment between the first side of the first pool component and the second side of the second pool component.

9. The combination of claim 8:

(a) wherein the first pool component has a shell with an upper surface;

(b) which includes a recess in the upper surface of the shell of the first pool component at the first side;

(c) wherein the second pool component has a shell with an upper surface;

(d) which includes a recess in the upper surface of the shell of the second pool component at the second side;

(e) wherein the tile edge is contained within the recess on the first side of the upper surface of the shell of the first pool component and the recess on the second side of the upper surface of the shell of the second pool component so as to provide an apparent seamless joint between the first pool component and the second pool component.

10. The combination of claim 6:

(a) wherein the first frame of the first pool component includes a first vertical frame support and a second vertical frame support;

(b) wherein the second frame of the second pool component includes a first vertical frame support that is aligned with the first vertical support of the first frame, and a second vertical frame support that is aligned with the second vertical support of the first frame;

(c) wherein said latch assembly further comprises a first latch assembly and a second latch assembly, each latch assembly having a first latch means and a second latch means, wherein the first latch means is adapted to be removably coupled to the second latch means, said first latch means of the first latch assembly being attached to the first vertical frame support of the first frame of the first pool component, said second latch means of the first latch assembly being attached to the first vertical frame support of the second frame of the second pool component so that the first latch means of the first latch assembly is aligned with and coupled to the second latch means;

(d) said first latch of the second latch assembly being attached to the second vertical frame support of the first frame of the first pool component, and said second latch means of the second latch assembly being attached to the second vertical frame support of the second frame of the second pool component so that the first latch means of the second latch assembly is aligned with and coupled to the second latch means.

11. The combination of claim 6:

(a) wherein the first frame of the first pool component includes a top horizontal frame support;

(b) wherein the second frame of the second pool component includes a top horizontal frame support that is aligned with the top horizontal frame support of the first frame;

(c) wherein the first latch means of the latch assembly is attached to the top horizontal frame support of the first frame of the first pool component, and the second latch means of the latch assembly is attached to the top horizontal frame support of the second frame of the second pool component so that the first latch means of the latch assembly is aligned with and coupled to the second latch means.

12. The combination of claim 6 wherein:

(a) the first latch means comprises:

(i) a first bracket;

(ii) a lever that is pivotally mounted to the first bracket;

(iii) a U-shaped lock that is pivotally mounted to the lever;

(b) the second latch means comprises a second bracket; wherein:

(c) the first bracket is attached to the first frame of the first pool component;

(d) the second bracket is attached to the second frame of the second pool component;

(e) the U-shaped lock of the first latch means is removably coupled to the second bracket.

13. The combination of claim 12 wherein the lever is adapted to be pivoted between a locked position in which the U-shaped lock is coupled to the second bracket and an unlocked position in which the U-shaped lock is uncoupled from the second bracket.

* * * * *